US008220246B2

(12) United States Patent
Widener

(10) Patent No.: US 8,220,246 B2
(45) Date of Patent: Jul. 17, 2012

(54) IMPINGEMENT COOLED CROSSFIRE TUBE ASSEMBLY

(75) Inventor: Stanley Kevin Widener, Greenville, SC (US)

(73) Assignee: General Electric Company, Schenectady, NY (US)

( * ) Notice: Subject to any disclaimer, the term of this patent is extended or adjusted under 35 U.S.C. 154(b) by 595 days.

(21) Appl. No.: 12/563,599

(22) Filed: Sep. 21, 2009

(65) Prior Publication Data

US 2011/0067406 A1 Mar. 24, 2011

(51) Int. Cl.
*F02C 3/00* (2006.01)

(52) U.S. Cl. ..... 60/39.37; 60/800; 60/752

(58) Field of Classification Search ..... 60/39.37, 60/39.821, 752–760, 796–800; 431/350–353
See application file for complete search history.

(56) References Cited

U.S. PATENT DOCUMENTS 4,249,372 A * 2/1981 White ..... 60/796
5,001,896 A 3/1991 Hilt et al.
5,265,413 A * 11/1993 Cannon et al. ..... 60/800
5,402,635 A * 4/1995 Smith et al. ..... 60/39.37
5,896,742 A 4/1999 Black et al.
6,334,294 B1 1/2002 Belsom et al.
6,705,088 B2 3/2004 Martling et al.
6,834,491 B2 * 12/2004 Coppola ..... 60/39.37
6,912,838 B2 7/2005 Sileo et al.
2007/0151260 A1 * 7/2007 Nichols et al. ..... 60/804

* cited by examiner

*Primary Examiner* — Louis Casaregola
*Assistant Examiner* — Phutthiwat Wongwian
(74) *Attorney, Agent, or Firm* — Dority & Manning, P.A.

(57) ABSTRACT

A crossfire tube assembly is configured for connecting adjacent combustion cans in a gas turbine, and includes a first tube segment having a first end and an opposite female end. A second tube segment has a first end and an opposite male end fitted concentrically within the female end with an overlap region between the female and male ends. Each of the first ends of the tube segments is configured for securing to a liner of a respective combustion can. Oppositely oriented first and second impingement sleeves extend from the female end of the first tube segment to the respective first ends of the tube segments. Combustion cooling air is directed through metering holes in the impingement sleeves and flows axially along concentric cavities defined between the impingement sleeves and the first and second tube segments. The combustion cooling air vents from the cavities into an axial combustion air flow stream between the respective combustion can liners and sleeves.

12 Claims, 4 Drawing Sheets

IMPINGEMENT COOLED CROSSFIRE TUBE ASSEMBLY

FIELD OF THE INVENTION

The present relates to gas turbine combustors, and more specifically to a crossfire tube configuration that extends between adjacent combustion chambers ("cans") arranged in a circle about the axial centerline of a gas turbine

BACKGROUND OF THE INVENTION

Conventional gas turbines typically include several combustion chambers (also referred to as "cans") arranged in a circle about the axial centerline of the turbine. The combustion cans are isolated from one another, except for the crossfire tube connections between adjacent cans. The crossfire tubes are essentially open tubular structures that serve to propagate hot gases and flame between adjacent cans during start up under the influence of a pressure differential between the respective cans. Typically, one or two of the cans incorporate an ignition device (e.g., a spark plug), while the other cans are lighted by the flame passing through the crossfire tubes from the adjoining lit can. In addition, the crossfire tubes may also pass flame from the lighted to the unlighted premixing regions of the combustion cans during transfer from a premixed mode to a lean-lean mode. In general, the specific function of the crossfire tubes, whether during ignition or re-light of the premixing zone, is simply to pass flame from adjoining combustion cans. This process generally occurs in a matter of seconds. At all other times in the gas turbine operation, the crossfire tubes perform no specific function.

In theory, once all of the combustion cans are lit, their pressures equalize and the flow of gas and flame through the crossfire tubes should stop. In practical gas turbine engines, however, differences in geometry, air flow, and fuel metering between adjacent combustion cans may promote continuous gas and flame flow through the crossfire tube. Although a small amount of flow through the crossfire tubes does not affect the operation of the gas turbine engine and aids in balancing the pressures and flows from the combustion cans, continuous cross-flow of hot gas can permanently damage the combustion can liner or crossfire tube due to heating of the metal to its melting point.

One known method for discouraging continuous gas flow in crossfire tubes employs vent holes through the crossfire tubes. Pressurized purge air (from the compressor) flows inward through the vent holes and both cools any gas flowing in the crossfire tubes and counteracts the pressure differential along the length thereof. The purge air flow will prevent crossfire gas flow below a given pressure differential. In addition, the air flowing through the vent holes tends to cool the crossfire tube walls to reduce the temperature thereof. Reference is made, for example, to U.S. Pat. Nos. 5,896,742 and 6,334,294.

U.S. Pat. No. 5,001,896 describes a crossfire tube assembly that incorporates an impingement sleeve within which a crossfire tube is centrally disposed. The sleeve includes an array of cooling holes that direct cooling air upon the crossfire tube. The space between the impingement sleeve and the crossfire tube forms a flow channel along which the impingement air flows in the axial direction before being directed into the interior of the combustion cans.

Conventional crossfire tubes designed to prevent continuous crossfire by injection of pressurized purge air into the tube cavity through vent holes are disadvantageous in that the purge air bypasses the head-end of the combustion cans and thus is not available for the premixing of air and fuel supplied to the combustion cans, resulting in decreased efficiencies and increased emissions. This disadvantageous aspect also applies to the impingement sleeve configuration of the U.S. Pat. No. 5,001,896 discussed above in that the impingement air is eventually vented directly into the combustion cans without mixing with fuel at the head-end.

The industry would thus benefit from a robust and effective system for cooling crossfire tubes that does not decrease the amount of combustion air available for premixing with fuel at the head end of the combustion cans.

BRIEF DESCRIPTION OF THE INVENTION

Aspects and advantages of the invention will be set forth in part in the following description, or may be obvious from the description, or may be learned through practice of the invention.

In accordance with aspects of the invention, a first embodiment a crossfire tube assembly is provided for connecting adjacent combustion cans in a gas turbine. The assembly includes a first tube segment having a first end and an opposite female end. A second tube segment has a first end and an opposite male end that fits concentrically within the female end of the first tube segment such that an overlap region is defined between the female and male ends. The first ends of the respective first and second tube segments are configured for securing to a liner of a respective combustion can. A first impingement sleeve extends from the female end of the first tube segment to first end of the first tube segment, and a second impingement sleeve extends from the female end of the first tube segment in an opposite direction to the first end of the second tube segment. The impingement sleeves have a plurality of metering holes defined therein.

With the configuration set forth above, combustion cooling air is directed through the impingement sleeves and flows axially along concentric cavities defined between the first and second impingement sleeves and the first and second tube segments, respectively. The combustion cooling air is vented from the cavities, for example through metering holes defined in an annular ridge at the ends of the tube segments, and flows into the axial combustion airflow stream between the combustion can liners and respective combustion can sleeves. Thus, the crossfire tube cooling air is not lost and is available at the head end of the combustion cans for premixing with fuel.

The present invention also encompasses a method for cooling crossfire tubes that connect adjacent combustion cans in a gas turbine. The method includes connecting a male end of a first tube segment into a female end of a second tube segment so that an overlap region is formed between the male and female ends. The opposite ends of the tube segments are connected to respective liners of adjacent combustion cans. An impingement sleeve is configured around each of the first and second tube segments so as to define an axially extending cavity between the first and second tube segments and respective impingement sleeves. Combustion cooling air is introduced through the impingement sleeves and into the cavities around each of the first and second tube segments. The combustion cooling air is directed in opposite directions on either side of the overlap region such that the combustion cooling air flows axially away from the overlap region in each of the cavities towards the combustion can liners. The cooling air is vented from the cavities and merges with the axial combustion airflow stream between the combustion can liners and respective combustion can sleeves to the head end of the combustion cans.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
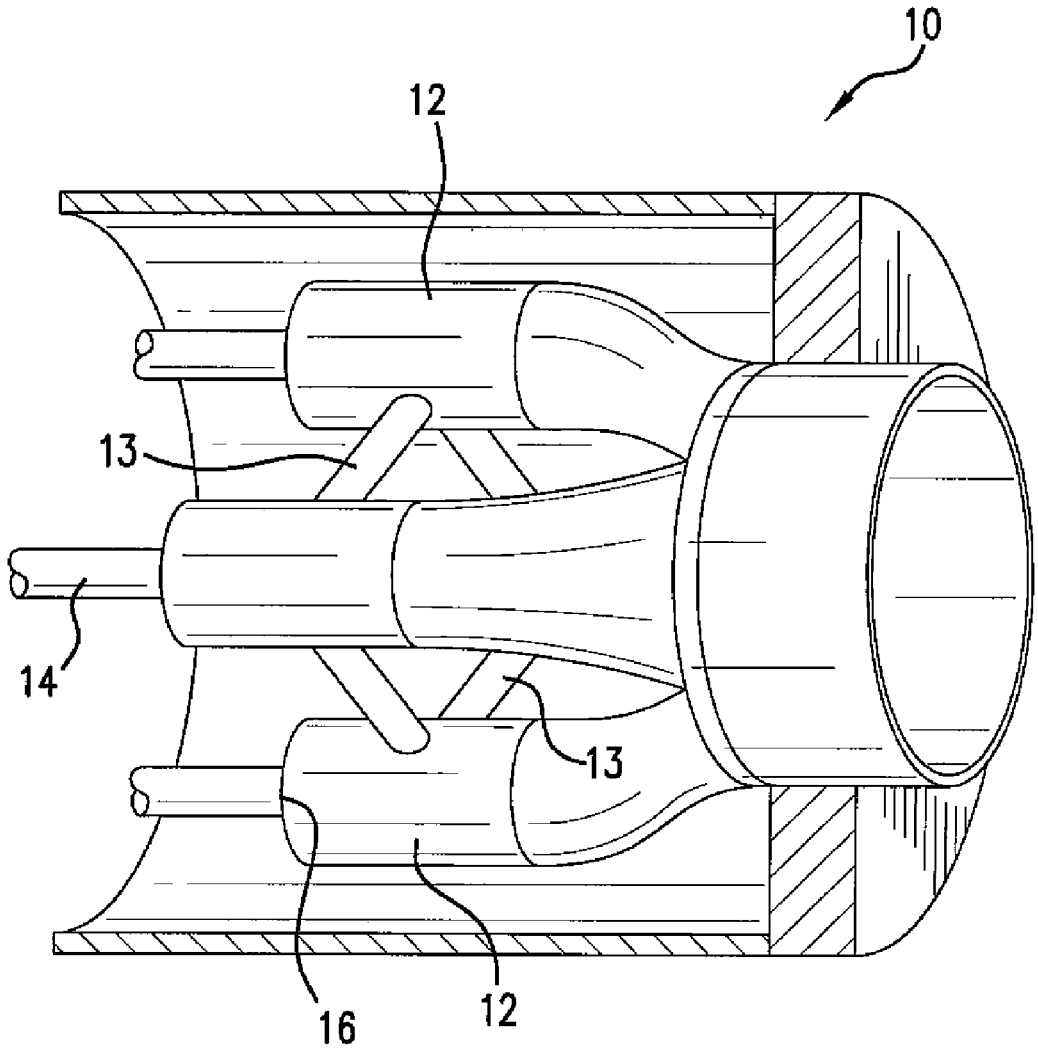
FIG. 1 is a cut-away perspective view of a conventional combustor.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

FIG. 1 illustrates a typical gas turbine combustor array 10 that includes a plurality of individual combustors or "cans" 12 equally spaced around an axis of the gas turbine. Each can 12 is typically cylindrical in shape and receives a fuel supply at a fuel fitting 14 at a head-end 16 thereof. As is understood in the art, compressed air is directed in an axial counter-flow airstream between a sleeve and liner of each can to the head-end 16 for combustion with the fuel. A plurality of individual crossfire tubes 13 interconnect the plurality of cans 12 for the functions discussed above. The present invention relates to the configuration of each of the crossfire tube assemblies.

Figure 2:
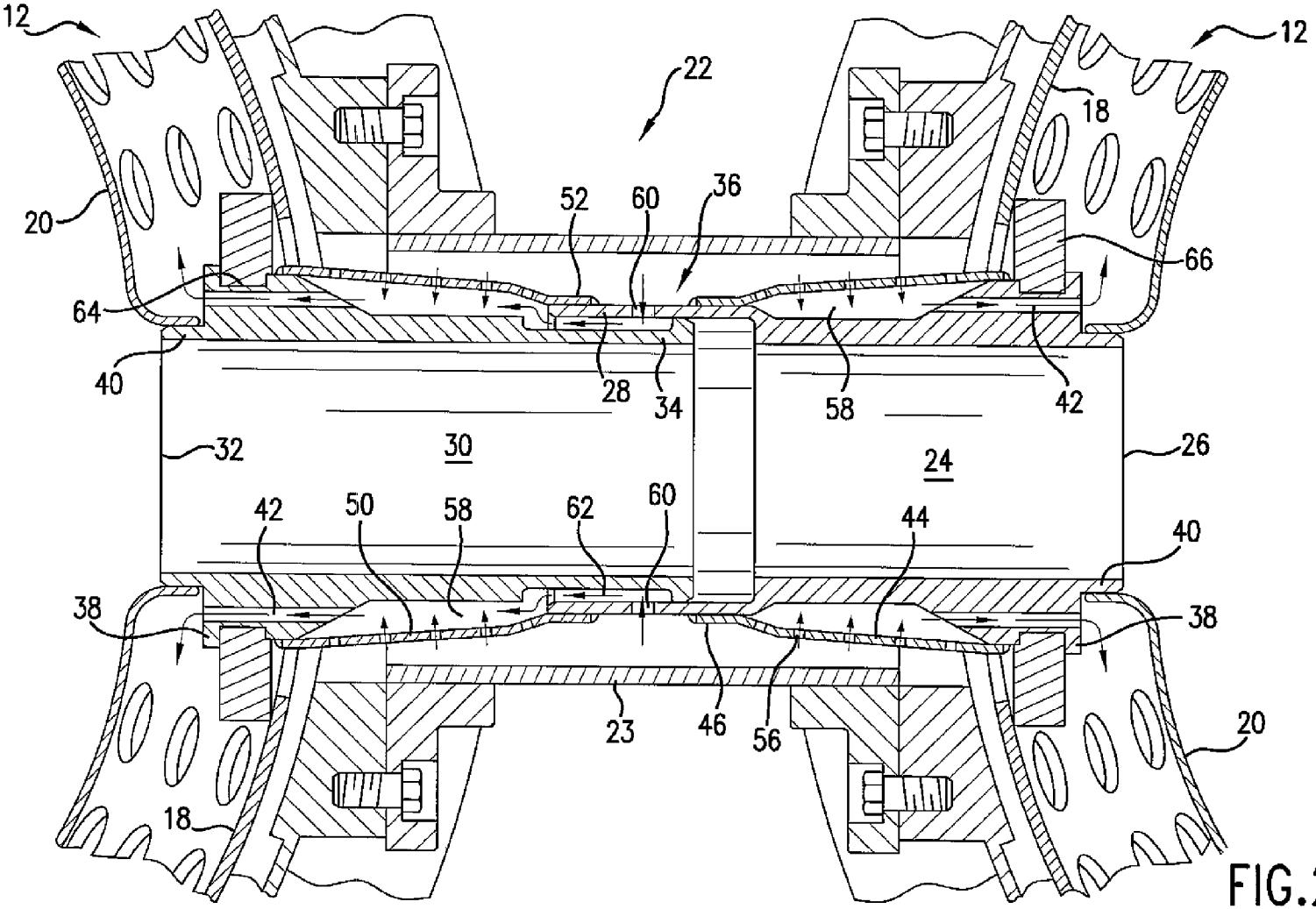
FIG. 2 is a cross-sectional view of a crossfire tube configuration in accordance with aspects of the invention.

FIG. 2 is a cross-sectional view of a crossfire tube assembly 22 in accordance with aspects of the invention. The assembly 22 is connected between adjacent cans 12. Each of cans 12 includes an inner liner 20 concentrically disposed within a sleeve 18. An axially directed combustion airflow stream is established in operation of the turbine combustor between the sleeve 18 and liner 20 for each of the cans 12 for supply of compressed air to the respective head-end 16 of each can 12. The crossfire tube assembly 22 includes various components as described below concentrically disposed within a pressure sleeve 23. A portion of the compressed air from the compressor is supplied into the sleeve 23 for cooling the internal components of the crossfire tube assembly 22 as described herein.

The crossfire tube assembly 22 includes a first tube segment 24 depicted in the right-hand portion of FIG. 2. This first tube segment 24 includes a first end 26 that is open to a respective can 12, and an opposite female end 28. A second tube segment 30 is depicted in the left-hand portion of FIG. 2 and includes a first end 32 that is open to an adjacent can 12, and an opposite male end 34. The male end 34 is fitted concentrically within the female end 28 of the first tube segment 24 such that an overlap region 36 is defined between the female end 28 and male end 34 in a telescoping relationship between the respective ends.

The first end 26 of the first tube segment 24 and first end 32 of the second tube segment 30 are each configured for securing to the liner 20 of the respective combustion can 12, as illustrated in FIG. 2. A shoulder 40 may be provided at each of the ends 32, 26 for mating with a turned flange portion of the respective liners 20, as particularly illustrated in FIG. 2.

Each of the first ends 26, 32 of the respective tube segments 24, 30 may include an annular ridge 38 adjacent to the respective ends 26, 32. The annular ridge 38 may, for example, be disposed immediately adjacent to the shoulder 40, as illustrated in FIG. 2. Each of the annular ridges 38 may include a slot 64 that cooperates with a respective clip 66 for retaining the ends of the tubes 24, 30 in an assembled configuration with the combustor cans 12. It should be appreciated, however, that the crossfire tube assembly 22 is not limited to any particular type of connection configuration with the cans 12.

A first impingement sleeve 44 is configured with the first tube segment 24 and extends from the overlap region 36 of the female end of the tube segment 24 to the annular ridge 38 of the first tube segment 24. The impingement sleeve 44 may have a cylindrical or tapered configuration as illustrated in FIG. 2, and includes a plurality of metering holes 56 defined therethrough. A cavity 58 is defined between the first impingement sleeve 44 and the outer circumferential surface of the first tube segment 24. Pressurized combustion cooling air is directed through the metering holes 56 and into the cavity 58, as particularly illustrated in FIG. 2.

A second impingement sleeve 50 extends from the overlap region 36 of the female end 28 in an opposite direction so as to extend over the outer circumferential surface of the second tube segment 30. The second impingement sleeve 50 extends to the annular ridge 38 of the second tube segment 30 and defines a cavity 58 with the second tube segment. The pressurized combustion cooling air flows through holes 56 defined in the impingement sleeve 50 and into the cavity 58.

Referring again to FIG. 2, the combustion cooling air moves axially along the cavities 58 in opposite directions relative to the overlap region 36 and vents from the cavities so as to combine with the axial combustion airflow stream between the can liners 20 and sleeves 18. In the illustrated embodiments, the combustion cooling air vents from the cavities 58 through metering holes or passages 42 defined in the annular ridges 38 at the respective first ends of the tube segments 24, 30 above the shoulders 40. This flow path is particularly illustrated in FIG. 5.

Figure 3:
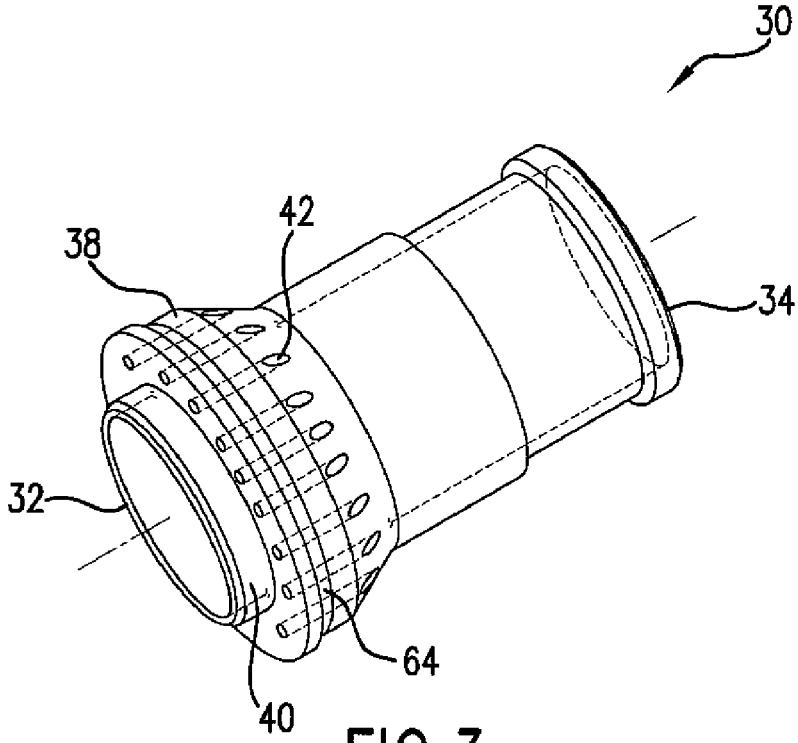
FIG. 3 is a perspective view of a tube segment from the embodiment of the crossfire tube configuration of FIG. 2.
Figure 4:
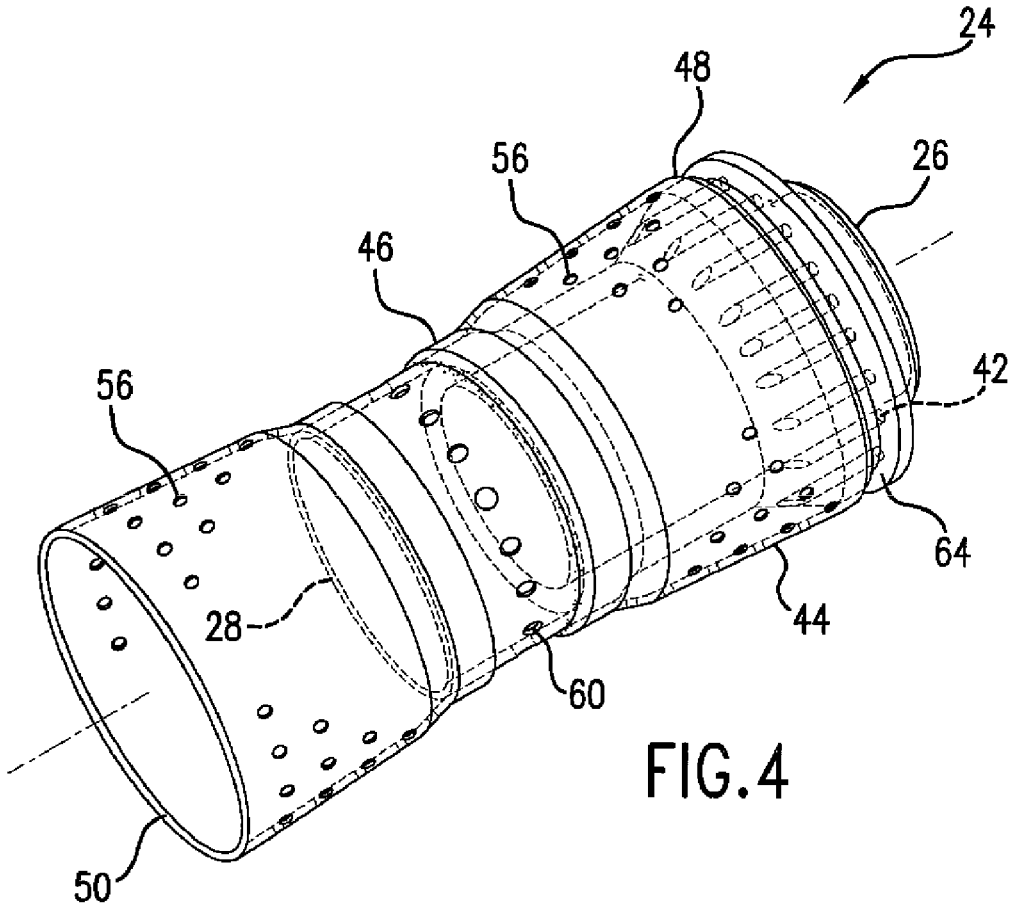
FIG. 4 is a perspective view of a different tube segment from the embodiment of the crossfire tube configuration of FIG. 2.
Figure 5:
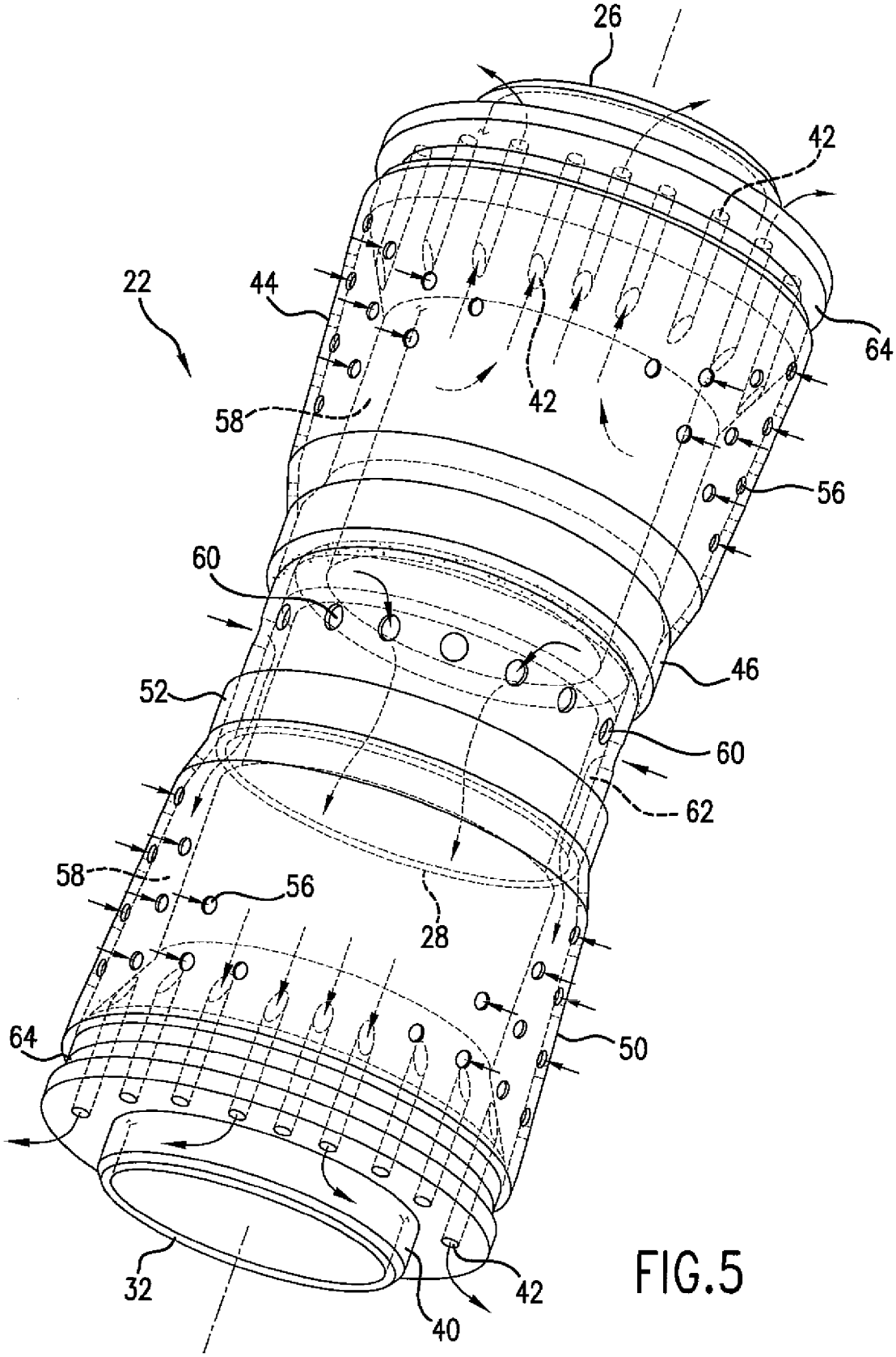
FIG. 5 is a perspective view of the tube segments of the FIGS. 3 and 4 in a connected configuration.

Referring to FIGS. 2, 4, and 5, the female end 28 of the first tube segment 24 may also include a plurality of metering holes 60 defined in the overlap region 36. The male end 34 of the second tube segment 30 also comprises a vent passage 62 that is in communication with the metering holes 60. In this configuration, combustion cooling air is also directed through the metering holes 60 and into the vent passage 62 so that adequate cooling is provided to the overlap region 36 of the tube segments 24, 30. The vent passage 62 is in communication with the cavity 58 around the second tube segment 30, as particularly illustrated in FIG. 2. In the illustrated embodiment, the vent passage 62 is defined by an annular recess adjacent to the male end 34 of the second tube segment 30, as particularly illustrated in FIG. 3.

In a particular embodiment, the respective impingement sleeves 44, 50 include respective first ends 46, 52 that are rigidly attached to the female end 28 of the first tube segment in the overlap region 36. These ends 46, 52 may be attached, for example, by welding, or mechanical means. The ends 46, 52 are spaced axially apart, as particularly illustrated in FIG. 4, with the metering holes 60 defined in the overlap region of the female end 28 between the ends 46, 52. The opposite ends 48, 54 of the respective impingement sleeves 44, 50 extend to the annular ridge 38 of the tube segments 24, 30. The sleeve ends 48, 54 need not be rigidly attached to the annular ridge 38 and may "float" on the annular ridge 38 to accommodate assembly of the tube segments 24, 30, as well as any relative axial movement between the components.

The impingement sleeves 44, 50 may be separate individual components having separate ends 46, 52 that are attached to the female end 28, as in the illustrated embodiment. In a different embodiment, the impingement sleeves 44, 50 may be portions of a single unitary sleeve that extends completely over the overlap region 36. In this embodiment, the metering holes 60 would be defined through the unitary sleeve member in the overlap region 36.

FIG. 3 is a perspective view of the second tube segment 30, and particularly illustrates features discussed above.

FIG. 4 is a perspective view of the first tube segment 24, and particularly illustrates features of the tube segment discussed above.

FIG. 5 is a perspective view of the tube segments 24 and 30 in an assembled configuration, and particularly illustrates the various flow paths of the combustion cooling air through the tube segments 24, 30.

The present invention also encompasses various embodiments of a method for cooling crossfire tubes that connect adjacent combustion cans in a gas turbine in accordance with the principles discussed above. In particular, an exemplary method includes connecting a male end of a first tube segment into a female end of a second tube segment so that an overlap region is formed between the respective male and female ends. The opposite ends of the connected tube segments are engaged or connected to respective liners of adjacent combustion cans. Impingement sleeves are configured around the first and second tube segments so as to define an axially extending cavity between the first and second tube segments and the respective impingement sleeves. Combustion cooling air is introduced into a chamber around the impingement sleeves and flows through metering holes in the impingement sleeves and into cavities around each of the first and second tube segments. The cavities are defined between the impingement sleeves and the outer circumferential surface of the tube segments. The combustion cooling air is directed in opposite directions on either side of the overlap region between the tube segments and flows axially away from the overlap region in each of the cavities, thereby cooling the axial length of the tube segments. The combustion cooling air is vented from the cavities towards the combustion can liners and merges with the axially directed combustion airflow stream between the can liners and can sleeves.

The method may further include directing combustion cooling air in a manner so as to focus cooling on the overlap region between the tube segments. For example, cooling air may be directed through metering holes in the female end of the first tube segment in the overlap region, with this air being directed axially along a vent passage in the male end of the second tube segment. The air flows along the vent passage in the second tube segment and merges with the combustion cooling air flowing along the cavity around the second tube segment.

The combustion cooling air flowing along the cavities around the tube segments may be vented to the axial combustion airflow stream between the can sleeves and liners in various configurations. For example, the tube segments may be connected to the combustion cans with an annular ridge that engages or is otherwise connected to the can liner. Metering holes may be defined in the annular ridges so that the air vents from the cavities through the metering holes and into the axial combustion air flow.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A crossfire tube assembly for connecting adjacent combustion cans in a gas turbine, comprising:

a first tube segment having a first end and an opposite female end;

a second tube segment having a first end and an opposite male end fitted concentrically within said female end with an overlap region between said female end and said male end;

each of said first ends of said first and second tube segments securing to a liner of a respective combustion can;

a first impingement sleeve extending from said female end to said first end of said first tube segment, and a second impingement sleeve extending from said female end in an opposite direction to said first end of said second tube segment, said impingement sleeves having a plurality of metering holes defined therein;

concentric cavities defined between said first and second impingement sleeves and said first and second tube segments, respectively; and wherein combustion cooling air is directed through said impingement sleeves and flows axially along said concentric cavities, the combustion cooling air venting from said cavities into an axial combustion airflow stream between the respective combustion can liners and sleeves.

2. The crossfire tube assembly as in claim 1, wherein said first and second tube segments comprise an annular ridge at said respective first ends, said annular ridges comprising a plurality of axially oriented metering holes defined therein through which the combustion cooling air vents from said cavities.

3. The crossfire tube assembly as in claim 2, wherein said impingement sleeves are unattached to and float on said respective annular ridges of said first and second tube segments.

4. The crossfire tube assembly as in claim 2, wherein said first ends of said first and second tube segments comprise a shoulder section for attachment to a respective combustion can liner, said metering holes in said annular ridges disposed at a height above said shoulder so that combustion cooling air exiting said metering holes flows along the combustion can liner.

5. The crossfire tube assembly as in claim 1, wherein said female end further comprises a plurality of metering holes defined therein around said overlap region, and said male end comprises a vent passage in communication with said metering holes in said female end and with said concentric cavity around said second tube segment, whereby combustion cooling air is also directed through said metering holes in said female end around said overlap region and flows axially along said vent passage in said male end and into said concentric cavity around said second tube segment.

6. The crossfire tube assembly as in claim 3, wherein said vent passage comprise an annular groove defined in said male end that opens into said concentric cavity beyond said overlap region.

7. The crossfire tube assembly as in claim 1, wherein said first and second impingement sleeves are separate components separately attached to said female end at said overlap region.

8. The crossfire tube assembly as in claim 7, wherein said impingement sleeves have a first end attached to said female end at said overlap region.

9. The crossfire tube assembly as in claim 8, wherein said first ends of said impingement sleeves are spaced axially apart on said female end, said metering holes in said female end defined between said first ends of said impingement sleeves.

10. A method for cooling crossfire tubes that connect adjacent combustion cans in a gas turbine, comprising:

connecting a male end of a first tube segment into a female end of a second tube segment so that an overlap region is formed between the male and female ends;

connecting opposite ends of the connected tube segments to respective liners of adjacent combustion cans;

configuring impingement sleeves around the first and second tube segments so as to define an axially extending cavity between the first and second tube segments and respective impingement sleeves;

introducing combustion cooling air through the impingement sleeves and into the cavities around each of the first and second tube segments;

directing the combustion cooling air in opposite directions on either side of the overlap region such that the combustion cooling air flows axially away from the overlap region in each of the cavities towards the combustion can liners; and venting the combustion cooling air from the cavities so that the cooling combustion air merges with the axial combustion airflow stream between the combustion can liners and respective combustion can sleeves.

11. The method as in claim 10, further comprising directing combustion cooling air through the female end in the overlap region and axially along the male end in the overlap region to merge with the combustion cooling air in the cavity around the first tube segment.

12. The method as in claim 10, comprising venting the air from the cavities around the first and second tube segments through metering holes in annular ridges formed at the opposite respective ends of the first and second tube segments, the metering holes disposed radially outward of a point of attachment of the tube segment ends with the combustion can liners.

* * * * *